US006074760A

United States Patent [19]

Krauter

[11] Patent Number: 6,074,760

[45] Date of Patent: Jun. 13, 2000

[54] HEAT TRANSFER TAPE

[75] Inventor: Heinrich Krauter, Hombrechtikon, Switzerland

[73] Assignee: Pelikan Produktions AG, Switzerland

[21] Appl. No.: 08/952,296

[22] PCT Filed: Mar. 24, 1997

[86] PCT No.: PCT/EP97/01488

§ 371 Date: Feb. 9, 1998

§ 102(e) Date: Feb. 9, 1998

[87] PCT Pub. No.: WO97/36753

PCT Pub. Date: Oct. 9, 1997

[30] Foreign Application Priority Data

Mar. 28, 1996 [DE] Germany ..... 196 12 393

[51] Int. Cl.[7] ..... B41M 5/10

[52] U.S. Cl. ..... 428/488.4; 346/218; 428/195; 428/480; 428/484; 428/500; 428/913; 428/914

[58] Field of Search ..... 428/195, 200, 428/204, 206, 212, 323, 500, 488.4, 913, 914, 420, 484, 488.1, 480; 346/218

[56] References Cited

U.S. PATENT DOCUMENTS

| | | | |
|---|---|---|---|
| 4,708,903 | 11/1987 | Tanaka et al. . | |
| 4,736,428 | 4/1988 | Deprettere et al. . | |
| 4,840,837 | 6/1989 | Tanaka et al. . | |
| 4,970,119 | 11/1990 | Koshizuka et al. . | |
| 5,219,610 | 6/1993 | Koshizuka et al. . | |
| 5,269,866 | 12/1993 | Kushida et al. . | |
| 5,484,644 | 1/1996 | Imamura et al. | 428/195 |
| 5,605,766 | 2/1997 | Arimura et al. . | |

FOREIGN PATENT DOCUMENTS

| | | |
|---|---|---|
| 2062495 | 6/1972 | Germany . |
| 3507097 A1 | 9/1985 | Germany . |
| 64-38271 | 8/1989 | Japan . |

*Primary Examiner*—Bruce Hess
*Assistant Examiner*—Michael E. Grendzynski
*Attorney, Agent, or Firm*—Fay, Sharpe, Fagan, Minnich & McKee, LLP

[57] ABSTRACT

A heat transfer tape has a usual substrate, a layer of heat transfer ink on one side of the substrate and a separation layer between the substrate and the layer of heat transfer ink. The separation layer is waxed and contains waxes having a melting point from about 70 to 110° C., as well as a wax softening polymer with a glass transition temperature Tg from −30 to −70° C. The layer of heat transfer ink contains at least 20 wt % natural resin, modified natural resin and/or synthetic resin. This heat transfer tape gives particularly scratch- and solvent-resistant prints.

18 Claims, No Drawings

HEAT TRANSFER TAPE

BACKGROUND OF THE INVENTION

The invention concerns a thermo-transfer ribbon with a standard carrier and a layer of thermo-transfer color formed on one side of the carrier, and a separation layer between carrier and the layer of thermo-transfer color.

Thermo-transfer ribbons have been known for some time. They have, on a foil-type carrier, consisted of for example, paper, plastic or similar materials, and a thermo-transfer color, specifically in the form of a plastic- and/or wax-bonded dye- or carbon black layer. The thermo-transfer color is softened in thermo-print technology by means of a thermal print head and transferred to recording or printing paper. Thermal printers or thermo print heads which can be used for this process are known, for example, from DE-AS 20 62 495 and 24 06 613 and from DE-OS 32 34 445. The following step-by-step procedure may, for example, be followed: On the thermo-print head of the printer a letter, which consists of heated dots and which is to be printed onto a piece of paper, is formed. The thermo-print head presses the thermo transfer ribbon onto imprintable paper. The heated letter of the thermo print head, having a temperature of approximately 400° C. causes the thermo-transfer color to be softened at the heated location and transferred to the piece of paper in contact therewith. The utilized part of the thermo-transfer ribbon is passed to a spool.

So-called serial or line printers may be employed for printing. The serial printers operate with a relatively small, movable print head up to approximately 1 $cm^2$. On it are arranged, vertically relative to the printing direction, one or two rows of dots (dot=targeted heated point). The dot diameter ranges between approximately 0.05 and 0.25 mm. The number of dots per dot-line ranges between 6 and 64, which corresponds to a resolution of between 2 to 16 dots/mm. Higher resolutions, for example 24 to 32 dots/mm, can be expected in the near future. It is characteristic with respect to the serial thermal head that it is moved, during the printing process, horizontally relative to the transport direction of the paper. In contrast to the serial print head, the line print head has a stationary head or a strip. Since the print strip is not mobile, it must span the width of the to-be-printed substrate. Print strips are available in length of up to 297 mm. Resolution and dot-size correspond to those of serial heads. Serial printers are employed in typewriters, video prints, in the field of personal computers and also in word processors, while line printers are specifically employed in bar code printers, in high data volume computer output units, in fax machine applications, ticket printers, address printers, color copiers and in CAD/CAM systems.

In the above described systems of thermo-transfer ribbons, the printing sharpness and the optical density of the produced print depends, among others, upon adhesion of the thermo-transfer color to the paper. These features are proportional to the adhesion surface and the adhesive force. Rough paper has a smaller adhesion surface, since only the protruding parts of the paper surface are moistened by the melted thermo-transfer color. In EP-A-O 137 532 and DE-A-35 07 097 a so-called "filling-layer" is formed on the layer of thermo-transfer color, which consists of an in-melted state low-viscosity material, which flows during the printing process into the valleys of the rough paper surface and thus increases the surface of adhesion. It is of disadvantage that the melted filling layer, in the case of very smooth paper, having a roughness of more than 200 Bekk, is no longer able to penetrate the paper, so that a layer remains between paper surface and color layer. The layer, therefore, has the effect of a "hold-off layer," as described in EP-A-0 042 954. The hold-off layer, however, results in insufficient color fastness, since it prevents the thermo-transfer color from penetrating the paper. A hold-off layer effect is unwanted with respect to a color-fast layer.

In order to avoid the above addressed drawbacks in the art, specifically to beneficially facilitate printing on rough as well as on smooth paper, EP-B-0 348 661 proposes to incorporate the hold-off layer or the adhesive layer, also called topcoat, in a tackifying hydrocarbon resin, embedded in finely distributed form in a paraffin, whereby the paraffin has a melting point from 60 to 95° C. The teaching according to EP 0 206 036 attempts to avoid the necessity of such an adhesive layer or topcoat in that the wax layer is formed on the layer of a plastic-bonded thermo-transfer color and the plastic-bonded thermo-transfer color contains a thermo-plastic synthetic substance having a softening pont from 60 to 140° C.

The above described thermo-color ribbons find more and more entry in industrial applications, whereby in such applications a so-called "near-edge" print head is frequently being employed. In these print heads, the dot row is arranged close to the edge on a ceramic substrate. The advantage of the edge-type heads lies in shorter cool-down times and correspondingly higher printing frequency. Printing speeds from 2 to 4 inches per second can be obtained with it. Specific requirements are set with respect to print quality of the obtained prints, i.e., excellent edge sharpness, resolution and optical density. The printing of paper labels, specifically bar code labels, constitutes a special application field.

With respect to the latter, high scratch and solvent resistance of the prints is desirable. The printed labels shall resist a temperature stress of up to 100° C. without taking on a shabby appearance. EP-B-0 380 920 recommends for obtaining scratch-proof printouts that during the thermo print process, non-melting, dye-substance-containing polymer pellets are included in the melt-on color, which are meltable during a heat treatment which follows the thermo-print process. The symbols obtained immediately following the printing process initially do not have the desired scratch resistance. Scratch resistance is achieved by supplying additional heat to the symbol, whereby a new structure of the printed symbol sets in. This suggestion is detrimental to the extent that it requires a second heat treatment step after the printing process itself.

The thermo color ribbons for industrial application printers provided as state-of-the-art to date do not meet the addressed requirements to the desired extent.

Therefore, the invention is based on the object of making available a thermo-transfer ribbon, whose thermo-transfer color, transferred specifically during printing on paper labels, demonstrates excellent adhesion, as well as excellent rub-off resistance, which is, nevertheless, released rapidly and dot-accurately together with the underlying separation or release layer.

This object is solved according to the invention in that the separation layer is wax-bonded and contains waxes having a melting point ranging between approximately 70 to 110° C., and also a polymer wax plastifier with a glass transition temperature Tg of approximately −30 to +70° C., and that the layer of the thermo-transfer color contains at least approximately 20% by weight of natural resin, modified natural resin and/or synthetic resin.

In a preferred specific embodiment of the thermo-transfer ribbon according to the invention, the layer of thermo-transfer color contains, in addition, a wax-compatible polymer.

The waxes used as a layer of separation within the parameters of the invention agree with the standard wax definition, with the above limitation in regard to the melting point of approximately 70 to 110° C. This involves, in its most comprehensive sense, material which is solid to brittle-hard, coarse to fine crystalline, transparent to opaque, but which is not glass-like, which melts above approximately 70° C., but which, in fact, only slightly above its melting point is relatively low-viscosity and not stringy. Waxes of this type can be divided into hydrocarbon waxes (alkanes without functional groups) and into waxes of long-chained organic compounds with functional groups (primarily ester- and acid waxes). Hydrocarbon waxes include, aside from mineral wax, solid hydrocarbon waxes obtained form crude oil and tar, as well as synthetic paraffins. Among the waxes with functional groups are all the vegetable waxes and also the chemically modified waxes. Ester waxes consist, in essence, of esters which are formed from linear carbon acids with approximately 18 to 34 C-atoms and approximately equally long alcohols. In acid waxes there are high percentages of free carbon acids. Waxes with functional groups are preferred. To be specifically mentioned are ester waxes on the basis of montan wax, partially saponified ester waxes, acid waxes and oxidized and esterified synthetic waxes. Among the specifically preferred ester waxes are vegetable waxes, such as carnauba wax and candelilla wax. Particularly, preferred, within the scope of the invention, are waxes having a melting point between 80 and 105° C. Mention is made of the following specifically preferred waxes: Carnauba Wax, LG-Wax BASF and Hoechst Wax E.

The separation layer contains, in addition, a polymer wax plastifier with a glass temperature Tg of approximately −30 to +70° C., preferably of approximately −30 to +15° C. It has the effect that the preferably employed hard waxes, within the scope of the invention, specifically in the form of ester waxes, become plastified and thus lose their brittleness or "tendency to splinter." They assure good anchoring or adhesion of the separation layer to the carrier material. Ester waxes are very hard to brittle waxes, i.e., they can be pulverized in cold state. If they are mixed with the named polymer wax plastifiers, then there are created elastic products which can hardly be pulverized.

Considered as polymer wax plastifiers are polyesters, co-polyesters, polyvinyl-acetate, polystyroles. Among these, polyesters and co-polyesters are given preference. This preferably involves linear saturated polyesters or co-polyesters with average molecular weight from 1500 to 18000.

The polymer wax plastifier is preferably embedded in the separation layer in an amount of approximately 1 to 15% by weight, specifically approximately 4 to 15% by weight. Greater amounts of polymer wax plastifiers should be avoided, since, otherwise, the release effect vis-a-vis the carrier, for example a polyester foil, is insufficient. Too low an amount of polymer wax plastifier has the result, among others, that the brittle wax is insufficiently plastified and has poor adhesive property vis-a-vis the carrier.

The layer of the thermo-transfer color contains, as binding agent, natural resin, modified resin or synthetic resin. Suitable resins can be hydrocarbon resins, hydrated hydrocarbon resins, colophony resins, modified colophony resins, colophony esters, natural and synthetic polyterpenes and similar. Suitable resins include specifically every compatible resin or its compounds such as:

(1) glycerine- and penta-erythritol-ester of natural and modified colophony resins, such as for example the glycerine esters of tallow oil and tallow-wood resin, the glycerine esters of polymerized colophony, the penta-erythritol esters of hydrated colophony and the phenol-modified penta-erythritol-esters of colophony, (2) co-polymers and ter-polymers of natural terpenes, for example styrol/terpene and alpha-methyl-styrol/terpene, (3) poly-terpene-resins with a ring- and ball softening point from 60 to 150° C. And also hydrated poly-terpene resins, (4) phenol-modified terpene resins and their hydrated derivatives such as, for example, the resin product which is produced by means of condensation in an acid medium of a bi-cyclical terpene and a phenol, (5) aliphatic hydrocarbon resins with a ring- and ball softening point from 60 to 135° C. whereby the latter resins are obtained by means of polymerization of monomers, which primarily consist of olefins and di-olefins, as well as of hydrated aliphatic hydrocarbon resins, (6) aromatic hydrocarbon resins, such as the Cumaron-Inden-Resins and their hydrated derivatives, (7) alicyclical hydrocarbon resins and their hydrated derivatives and (8) acrylic styrol-copolymers, (9) adducts of dienophiles of resins, such as the maleinized resins. Preferred among these are hydrocarbon resins, colophony resins, modified colophony resins, colophony esters, maleinized resins, Coumarone-indene-resins, poly-terpene resins and/or terpene-phenol resins. For certain applications, mixtures of two or more of the above described resins may be required. The employed resin or the employed resin mixture has preferably a ring-, ball softening point between 80 to 120° C. Lower softening points result in insufficient temperature resistance of the printouts, higher softening points require inadmissibly high energy consumption during printing.

The color layer contains generally approximately 20 to 80, preferably approximately 40 to 60 percent by weight of natural resin, modified natural resin and/or synthetic resin.

In a preferred specific embodiment, the color layer contains in addition a wax-compatible polymer. By "wax-compatible" it is understood that this polymer is compatible with a liquid wax and that during cooling of a solution or a dispersion of the polymer in wax there will occur no phase break. Included in these are primarily ethylene-vinyl-acetate-co-polymer and other vinyl-acetate-co-polymers. Suitable polymers are for example: Elvax® 40W made by Dupont and Evatane® 28-800 made by Atochem. Additional wax-compatible polymers are ethylene-acrylic acid co-polymers, polyamides, ionomer resins, polyisobutenes (Oppanol®, BASF) and polyvinyl-ethyl, methyl- and -isobutyl-ether (Lutonal®, BASF). The wax-compatible polymer is present in the layer of the thermo-transfer color with approximately 1 to 20% by weight, specifically approximately 2 to 8% by weight.

Coloring can be done by any kind of dyes. This can involve pigments, such as specifically carbon black, but also solvents and/or dyes soluble in a binding medium, such as the commercial product Basoprint, organic color pigments as well as different azodyes (cerces- and sudan dyes). Carbon black is regarded as particularly suitable within the scope of the present invention. The thermo-transfer color preferably contains the color medium, specifically the color pigment, in an amount of approximately 20 to 40% by weight.

The viscosity of the thermo-transfer color must be sufficiently low, so that the color is released quickly and dot-accurately. The thermo-transfer color of the thermo-transfer ribbon according to the invention preferably has a viscosity of approximately 500 to 3000 mPa.s, measured at 140° C. with a Brookfield-Rotation-Viscosity Meter. Specifically targeted is the range from 600 to 1500 mPa.s.

It is of importance with respect to the present invention that the color layer contains a natural resin, a modified natural resin or a synthetic resin as binding medium. The resin envelops the color substance particles and thus assures excellent scratch resistance of the printouts. The increased rub-off or scratch resistance is based on the property of resins to anchor themselves extremely well on the paper during the printing process, and, contrary to waxes, they can withstand greater stress in thin layers. Resins, according to the invention, harden in air, in a thin layer, after the printing process. This results also in improved temperature stability of printouts.

The use of resins as binding agents for the layer of thermo-transfer color does, however, result in the color layer becoming highly brittle. Adequate adhesion of the "brittle" color layer to the separation layer is achieved by means of inclusion of relatively high quantities of polymer wax plastifiers in the wax-bonded separation layer. This, on the other hand, leads to simultaneous transfer of the separation layer during the printing process. This is evident from the brilliant appearance of the printouts, stemming from a thin layer of wax over the transferred print symbol itself of the resin-bonded color layer. Concurrent transfer of the separation layer produces added improvement in scratch resistance, since it is composed of hard ester waxes and polyester waxes. The natural resins, modified natural resins and/or synthetic resins employed in the color layer are therefore preferably wax-compatible.

After the printing process, separation of the color ribbon from the acceptor takes place when the transferred thermo-transfer color has already become solidified. This is primarily of importance when near-edge type print heads are employed.

The thickness of the color layer and of the separation layer are not critical. The separation layer preferably has a thickness of approximately 0.5 to 4 μm, specifically approximately 1 to 2 μm. The layer of the thermo-transfer color is preferably approximately 1 to 5 μm, specifically approximately 1 to 3 μm thick.

The type of carrier of the color ribbon according to the invention is likewise not critical. Preferably involved are polyethylene-terephthalate foil (PETP) or capacitor tissue. Selection parameters are stress/strain values as high as possible, thermal stability and thin foil thickness. PETP foils are available as thin as approximately 2.5 μm and capacitor tissue as thin as approximately 6 μm.

A beneficial refinement of the inventive concept, specifically for obtaining a beneficial print, is based on inclusion of the teaching of EP-B-O 133 638. Accordingly, a layer of wax or wax-like material is formed on the reverse side of the carrier, specifically with a thickness of not more than 1 μm, and specifically preferred in form of a molecularly formed thickness of up to 0.01 μm—the coating material consists in this case preferably of paraffin, silicone, natural waxes, specifically carnauba wax, bees wax, ozokerite and paraffin wax or synthetic waxes, specifically acid waxes, ester waxes, particularly saponified ester waxes and polyethylene waxes, glycols or poly-glycols and/or tensides.

In individual cases, it may be of advantage to incorporate additives which improve the properties of the ribbon. In such instance, the expert will select, within the scope of technical considerations, that with which he wishes to realize as the desired effect. The thermo-transfer ribbon can be produced in many ways, using customary application methods. It can be done, for example, by means of spraying or imprinting a solvent- or dispersion medium, by means of application from the melt, which specifically applies to the wax-bonded separation layer, or also by means of application via a wiper blade in the form of a watery suspension with finely therein dispersed application material. For application of both the release—as well as the color layer, application processes, such as reverse roll and/or gravure coating have proven themselves as particularly beneficial.

For the practical realization of the present invention, the following general conditions can be stated with respect to application amounts of the individual layers. The following layers are applied successively onto a carrier film, specifically a polyester film with a thickness of approximately 2 to 8 μm, specifically a thickness of approximately 4 to 5 μm. Separation layer 0.5 to 4 g/m$^2$, preferably approximately 1 to 2 g/m$^2$, and the thermo-transfer color layer with a thickness of 1 to 5 g/m$^2$, preferably approximately 1 to 3 g/m$^2$. Where required, the above mentioned reverse side coating is formed on the reverse side of the carrier with a thickness of approximately 0.01 to 0.2 g/m$^2$, specifically of approximately 0.05 to 0.1 g/m$^2$.

In the following, the invention is explained in more detail, based on examples.

EXAMPLE 1

On a standard carrier, made of a polyester having a thickness of approximately 6 μm, a material according to the following formula is applied for the formation of the separation layer.

| Separation Layer | |
|---|---|
| Carnauba Wax | 85 parts by weight |
| Dynapol ® S 1420 | 15 parts by weight |
| (saturated linear co-polyester) | |
| | 100 parts by weight |

The above material is applied by means of a blade in a solvent dispersion (approximately 10 percent, toluol/isopropanol 80:20) to a dry thickness of approximately 1.5 μm. Evaporation of the solvent is done via passage of hot air at a temperature of approximately 100° C. Subsequently, the thermo-transfer color is applied by means of reverse roll process, based on the following formula, in form of a solvent dispersion (approximately 15%, toluol/isopropanol 80:20):

| Color Layer | |
|---|---|
| Dercolyte M 90 (Polyterpene resin) | 67 parts by weight |
| Evatan ® 28-800 (Ethylene-vinyl-acetate co-polymer, vinylacetate contents approx. 28%) | 3 parts by weight |
| Carbon Black | 30 parts by weight |
| | 100 parts by weight |

EXAMPLE 2

Example 1 is repeated, but with the modification that for the separation layer and the color layer, the following formulas are used:

| Separation Layer | |
|---|---|
| Candelilla Wax | 90 parts by weight |
| Dynapol ® L205 | 10 parts by weight |
| (saturated high-molecular linear co-polyester) | |
| | 100 parts by weight |
| **Color Layer** | |
| Foralyn 90 (glycerine ester of hydrated colophony) | 65 parts by weight |
| Elvax ® 40W (ethylene-vinyl-acetate co-polymer vinylacetate content 40% by weight) | 5 parts by weight |
| Carbon Black | 30 parts by weight |
| | 100 parts by weight |

Having thus described the invention, it is claimed:

1. Thermo-transfer ribbon comprised of a carrier, with a layer of thermo-transfer color formed on one side and a separation layer between carrier and layer of thermo-transfer color, characterized in that the separation layer is wax-bonded and contains waxes having a melting point of approximately 70 to 110° C. and also a polymer wax plastifier which is selected from the group consisting of polyesters, copolyesters, polyvinyl acetates, polystyrols and mixtures thereof with a glass temperature Tg of approximately −30 to +70° C. and the layer of thermo-transfer color consists of colorant, 1 to 20% by weight wax compatible polymer and natural resin, modified natural resin and/or synthetic resin.

2. Thermo-transfer ribbon according to claim 1, wherein the wax of the separation layer has a melting point of approximately 80 to 105° C.

3. Thermo-transfer ribbon according to claim 1 wherein the polymer wax plastifier has a glass temperature Tg of approximately −30 to +15° C.

4. Thermo-transfer ribbon according to claim 1 wherein the wax of the separation layer is an ester wax.

5. Thermo-transfer ribbon according to claim 1 wherein the separation layer contains approximately 1 to 25% by weight of polymer wax plastifier.

6. Thermo-transfer ribbon according to claim 1 wherein the natural resin, the modified natural resin or the synthetic resin of the layer of the thermo-transfer color is selected from the group consisting of a hydrocarbon resin, a colophony resin, a modified colophony resin, a colophony ester, a maleic resin, a Coumarone-Indene resin, a polyterpene resin, a terpene-phenol resin and mixtures thereof.

7. Thermo-transfer ribbon according to claim 1 wherein the layer of the layer of thermo-transfer color contains approximately 40 to 60% by weight of natural resin, modified natural resin or synthetic resin.

8. Thermo-transfer ribbon according to claim 1, characterized in that the wax-compatible polymer is an ethylene-vinylacetate-co-polymer, ethylene-acrylic acid-co-polymer, polyamide and/or ionomer resin.

9. Thermo-transfer ribbon according to claim 1 wherein the thickness of the separation layer is approximately 0.5 to 4 μm.

10. Thermo-transfer ribbon according to claim 1 wherein the thickness of the layer of the thermo-transfer color is approximately 1 to 5 μm.

11. Thermo-transfer ribbon according to claim 1 wherein the carrier is a polyethylene-terephthalate foil.

12. Thermo-transfer ribbon according to claim 1 wherein on the reverse side of the carrier is a layer comprised of a wax or a wax-like material with a thickness of not more than 1 μm.

13. Thermo-transfer ribbon according to claim 1, wherein the thickness of the separation layer is approximately 2 μm.

14. Thermo-transfer ribbon according to claim 1, wherein the thickness of the layer of the thermo-transfer color is approximately 1 to 3 μm.

15. The thermo-transfer ribbon of claim 1 wherein said layer of thermo-transfer color comprises the outer most layer.

16. An industrial high-speed printer with a print head of the "near-edge"-type including thermo-transfer ribbon comprised of a carrier, having a layer of thermo-transfer color formed on one side and a separation layer between the carrier and the layer of thermo-transfer color, characterized in that the separation layer is wax-bonded and contains waxes having a melting point of approximately 70 to 110° C. and also a polymer wax plastifier which is selected from the group consisting of polyesters, copolyesters, polyvinyl acetates, polystyrols and mixtures thereof with a glass temperature Tg of approximately −30 to +70° C. and the layer of thermo-transfer color natural resin, modified natural resin and/or synthetic resin.

17. Thermo-transfer ribbon consisting essentially of a carrier, a layer of thermo-transfer color formed on one side and a separation layer between the carrier and the layer of thermo-transfer color, wherein the separation layer is wax-bonded and contains waxes having a melting point of approximately 70 to 110° C. and also a polymer wax plastifier which is selected from the group consisting of polyesters, copolyesters, polyvinyl acetates, polystyrols and mixtures thereof with a glass temperature Tg of approximately −30 to +70° C. and the layer of thermo-transfer color contains at least approximately 20% by weight of natural resin, modified natural resin and/or synthetic resin.

18. Thermo-transfer ribbon according to claim 17 wherein on the reverse side of the carrier is a layer comprised of a wax or a wax-like material with a thickness of not more than 1 μm.

* * * * *